US009424707B2

(12) United States Patent
Daniels et al.

(10) Patent No.: US 9,424,707 B2
(45) Date of Patent: Aug. 23, 2016

(54) ACTUATED CASTELLATION PLATE FOR A CURRENCY ACCEPTOR

(71) Applicant: MEI, Inc., Malvern, PA (US)

(72) Inventors: Robert Daniels, Douglassville, PA (US); Chris Marks, Philadelphia, PA (US); Robert Brown, Drexel Hill, PA (US); Ben Sidell, West Chester, PA (US)

(73) Assignee: Crane Payment Innovations, Inc., Malvern, PA (US)

( * ) Notice: Subject to any disclaimer, the term of this patent is extended or adjusted under 35 U.S.C. 154(b) by 0 days.

(21) Appl. No.: 14/316,071

(22) Filed: Jun. 26, 2014

(65) Prior Publication Data

US 2015/0379801 A1 Dec. 31, 2015

(51) Int. Cl.

| | |
|---|---|
| ***G07D 13/00*** | (2006.01) |
| ***G07F 1/04*** | (2006.01) |
| ***G07D 11/00*** | (2006.01) |
| ***G07F 7/04*** | (2006.01) |

(52) U.S. Cl.

CPC ..... *G07F 1/043* (2013.01); *G07D 11/0003* (2013.01); *G07D 11/0018* (2013.01); *G07D 11/0042* (2013.01); *G07F 7/04* (2013.01); *G07D 11/0021* (2013.01); *G07D 2211/00* (2013.01)

(58) Field of Classification Search

CPC ..... B65H 5/00; B65H 2402/50; B65H 2404/725; G07D 11/0003; G07D 11/0018; G07D 11/0021; G07D 2211/00

USPC ..... 194/202, 203, 349; 232/62, 63

See application file for complete search history.

(56) References Cited

U.S. PATENT DOCUMENTS

| | | | | |
|---|---|---|---|---|
| 5,195,739 | A * | 3/1993 | Watabe | 271/207 |
| 6,021,881 | A | 2/2000 | Wild | |
| 6,105,747 | A * | 8/2000 | Uemizo et al. | 194/203 |
| 6,668,998 | B1 * | 12/2003 | Mosteller et al. | 194/203 |
| 2003/0137095 | A1 * | 7/2003 | Ito et al. | 271/176 |
| 2004/0149537 | A1 | 8/2004 | Pai | |
| 2013/0015035 | A1 * | 1/2013 | Tanaka et al. | 194/206 |

OTHER PUBLICATIONS

Extended European Search Report dated Oct. 29, 2015 in connection with European Patent Application No. 15173876.2; 6 pages.

* cited by examiner

*Primary Examiner* — Mark Beauchaine

(57) ABSTRACT

An actuated castellation plate can be arranged across a length of a currency passageway of a currency acceptor assembly and configured in an open state. Pressure from an attempted string fraud, such as pulling in reverse a bill across the castellation plate, can actuate the castellation plate to a closed state, obstructing the currency passageway so that the bait bill cannot be retrieved. Embodiments can include a currency acceptor including a currency passageway, mounting assembly, currency storage assembly having an entrance, the currency passageway being arranged to guide a currency denomination to the entrance of the currency storage assembly, and an actuated castellation plate including an array of teeth coupled to a baseplate including a receptacle and two opposing mounting ends, the castellation plate being configured at the entrance of the cashbox assembly to transfer between an open and closed state. Related apparatus, systems, techniques, and articles are also described.

23 Claims, 10 Drawing Sheets

ACTUATED CASTELLATION PLATE FOR A CURRENCY ACCEPTOR

TECHNICAL FIELD

The subject matter described herein relates to fraud protection for currency acceptors, and more particularly to an improved anti-string fraud device and method.

BACKGROUND

Various types of valuable document validators for use in automatic transaction machines, such as vending or gaming machines, are well known. Typically, a consumer inserts coins and bills into such vending machines in order to purchase a product or service. Currency acceptors receive currency, for example paper money or coins, and perform various authenticity and denomination tests, and then either accept the tendered currency as valid or reject the currency and return it to the consumer. When accepted as genuine currency, the bill or coin is usually transported to a currency storage assembly, for example a cashbox or coin tube, where it is stored and a selected item is vended along with any change that may be due.

Thieves have been known to attempt to cheat vending machines to receive products or services without actually paying for them. Often, thieves fool currency acceptors with things that would not fool humans. For example, a thief may attach a string-like member, or any object capable of creating a tail, to a bill and then manipulating the tail to retrieve the bill after it has been accepted by a bill validator. This type of fraud is commonly known as "string-fraud." Although areas containing automatic transaction machines, such as vending machines and gaming machines, are increasingly monitored by automatic video devices, the string-fraud technique can be difficult to detect during or after an occurrence because during normal operation of the machine genuine bills are returned to consumers if they cannot be validated due to wear or foreign matter. Moreover, it is a never-ending game between thieves and the developers of automatic transaction machines—as thieves develop new methods to overcome current anti-fraud methods and devices, new countermeasures must be developed.

SUMMARY

One of the objectives of the present invention is to provide an improved anti-string fraud device and method. Currently, there are few solutions to prevent the latest string fraud techniques used by thieves, which utilize a wide tail attached to a bill for example, to fool automatic transaction machines. One such solution is an object of the present invention.

An example embodiment of the present invention includes a currency acceptor assembly including a currency passageway, mounting assembly arranged along a length of the currency passageway, currency storage assembly having an entrance coupled to the currency passageway, the currency passageway being arranged to guide a currency denomination (e.g., bill, coin, etc.) in a forward direction to the entrance of the currency storage assembly, and an actuated castellation plate mounted to the mounting assembly and configured to transfer between an open state and a closed state. The actuated castellation plate can include an array of teeth coupled to a baseplate, the baseplate can include a receptacle and two opposing mounting ends mounted to the mounting assembly.

In some example embodiments the currency acceptor assembly can further include a currency validator having an exit coupled to the currency passageway, the currency passageway being further arranged to guide currency in a forward direction from the exit of the currency validator toward the entrance of the currency storage assembly, wherein the mounting assembly is further arranged along the currency passageway between the currency validator and the currency storage assembly. The currency validator can be a bill validator operative to authenticate one or more bill denominations. The currency storage assembly can be a cashbox assembly operative to store the one or more bill denominations. In other example embodiments, the currency storage assembly can be a recycler assembly operative to recycle a bill denomination associated with providing a sum of change from a transaction. In still further embodiments the currency acceptor assembly can include multiple currency storage assemblies, such as multiple recycler assemblies and cashbox assemblies.

In some example embodiments the currency acceptor assembly can further include a spring mechanism coupled to the currency storage assembly and the receptacle of the baseplate, the spring mechanism being configured to transfer the castellation plate to the open state. The castellation plate can be arranged to be actuated from the open state to the closed state by the currency denomination (e.g., bill, coin, etc.) traveling in a reverse direction from the entrance of the currency storage assembly. The receptacle of the baseplate can be a first receptacle, the spring mechanism can be a first spring mechanism, the baseplate can further include a second receptacle, the first and second receptacles can be arranged on opposing sides of the baseplate, and the currency acceptor assembly can further include a second spring mechanism coupled to the second receptacle of the baseplate and the mounting assembly, the second spring mechanism being configured to further transfer the castellation plate to the open state. The two opposing ends of the baseplate can include a flat-end and a T-end, and the mounting assembly can further include a flat-groove and a T-groove matching the corresponding flat-end and the T-end, respectively, and arranged at the entrance of the currency storage assembly. In some example embodiments the mounting assembly can be integral to the currency storage assembly. The flat-groove can be a slot and the T-groove can have a closed-end and an open-end. The flat-groove and T-groove can be arranged off-horizontal. The castellation plate can be arranged to be actuated from the open state to the closed state by a string-like member attached to the currency denomination (e.g., bill, coin, etc.) traveling in a reverse direction from the entrance of the currency storage assembly. The array of teeth can be tree-shaped teeth forming restricted openings therebetween, and at least some of the teeth are adjacent to one another in a direction across the currency passageway, partially overlap one another without contacting one another, and can be angled such that any string-like member attached to the bill will be trapped within a restricted opening to further prevent extraction of the bill.

A still further example embodiment of the present invention can include an improvement to a known hook array for use with a bill acceptor including a plurality of tree-shaped teeth forming restricted openings therebetween and positioned in a currency passageway of the bill acceptor, wherein at least some of the teeth are adjacent to one another in a direction across a width of the passageway, partially overlap one another without contacting one another, and wherein the teeth are angled such that any string-like member attached to a bill will be trapped within a restricted opening to prevent extraction of the bill, and the improvement includes the plurality of tree-shaped teeth being transferable between an open position and a closed position, wherein the closed position at least partially obstructs the currency passageway and further prevents extraction of the bill. The hook array can further include a baseplate connected to the teeth. The baseplate can further include at least one receptacle to receive a spring mechanism. The baseplate and the teeth can be of a unitary construction. The baseplate can further include a flat end. The baseplate can further include at least one flange arranged at a flange end. At least one flange can be a T-shaped end. The hook array can further include sharp edges within at least one of the restricted openings. A top portion of at least one of the teeth can be curved to promote unimpeded travel of a bill in a first direction toward a cashbox and further promotes the teeth being transferred to the open state. An inner surface of at least one of the teeth can be abrasive to promote movement of the teeth to the closed position thereby obstructing travel of a bill in a second direction out of a cashbox.

A further example embodiment can include a currency acceptor assembly including a means for transporting a currency denomination (e.g., bill, coin, etc.) along a currency pathway in a forward direction to an entrance of a currency storage assembly, and a means for transferring a castellation plate between an open state and a closed state along the currency passageway at the entrance of the cashbox assembly.

The subject matter described herein provides many advantages. For example, example embodiments of the present invention can be used to prevent string fraud in which a thief utilizes a wide tail instead of a string-like member to prevent the string-like member from falling into the teeth of a hook array. Further advantages include that example embodiments are simple to implement and low cost. Therefore, automatic transaction machines that are currently deployed can be retrofitted relatively easily and inexpensively.

DESCRIPTION OF DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

As methods of detecting fakes and other anti-fraud technologies are developed and incorporated into currency acceptors, thieves, likewise, develop new techniques and methods to outmaneuver the new defenses in a never-ending cycle. For example, a hook array for a bill acceptor, as disclosed in U.S. Pat. No. 6,668,998, entitled "Hook Array For A Bill Acceptor" issued to Mosteller et al. on Dec. 30, 2003, the teachings of which are incorporated herein by reference in their entirety, was developed as a counter measure to the classic string-fraud. In general, to perform the classic string fraud the thief attaches a string-like member to a bill (or coin) and then manipulates the string-like member to retrieve the bill after it has been accepted by the bill validator. As used herein, a "string-like member" denotes any type of string, thin natural or artificial fiber, monofilament line, thin cord, thread, twine, tape, wire or the like that could be attached to a denomination of currency. Although the hook array can be successful at preventing classic string-fraud in which string-like members are used (the string-like members become stuck in the restricted openings of the hook array and prevent the accepted bill from being extricated from the bill acceptor), enterprising thieves have developed an outflanking technique.

To overcome the previous limitation, thieves create a wide tail to attach to a bill. For example, by overlapping a long length of packing tape so that the end portion of the bill is sandwiched between portions of the tape and the remaining length is adhered to itself, thieves can create a wide tail for string-fraud. Because the wide tail can avoid falling between the teeth of the hook array, thieves can overcome that defense. Therefore, there is a need for an improved device to prevent string-fraud that is simple to implement and low cost.

As used throughout this specification, the terms currency denomination, denomination of currency, valuable document, currency bill, bill, banknote, note, bank check, paper money, paper currency, coin, coinage, and cash may be used interchangeably herein to refer to a type of a negotiable instrument or any other writing that evidences a right to the payment of a monetary obligation, typically issued by a central banking authority.

Figure 1:
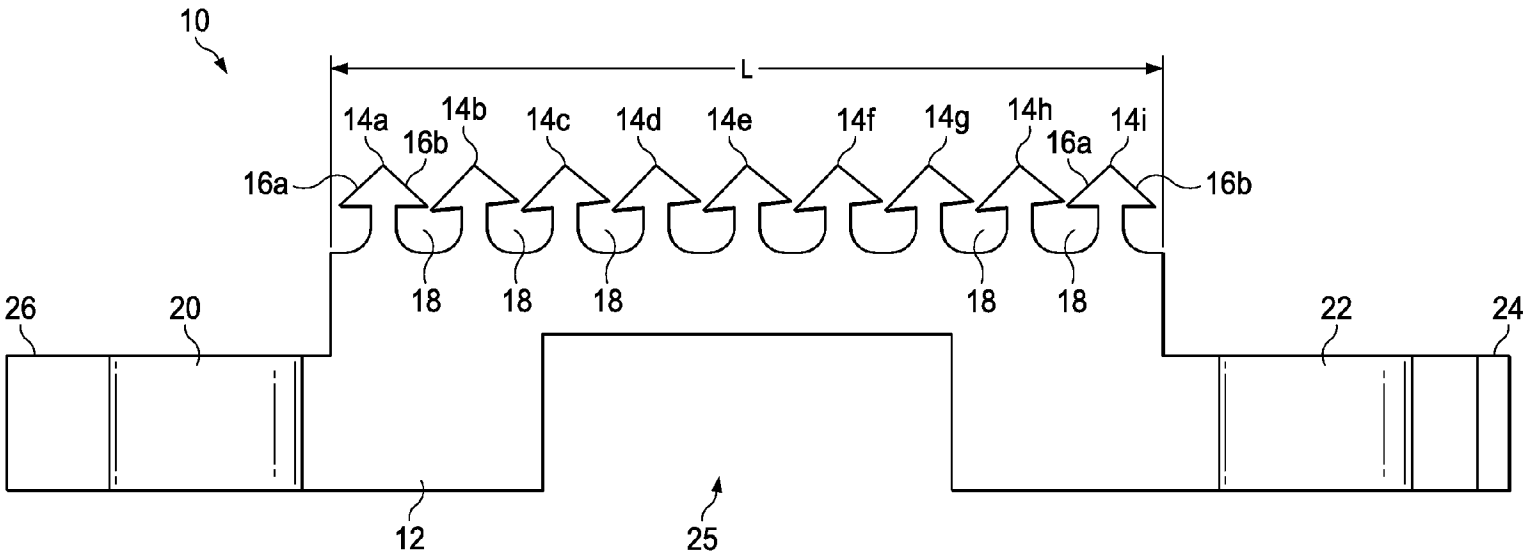
FIG. 1 is a plan view of an example embodiment of an actuated castellation plate for a currency acceptor assembly according to the present invention.
Figure 4A:
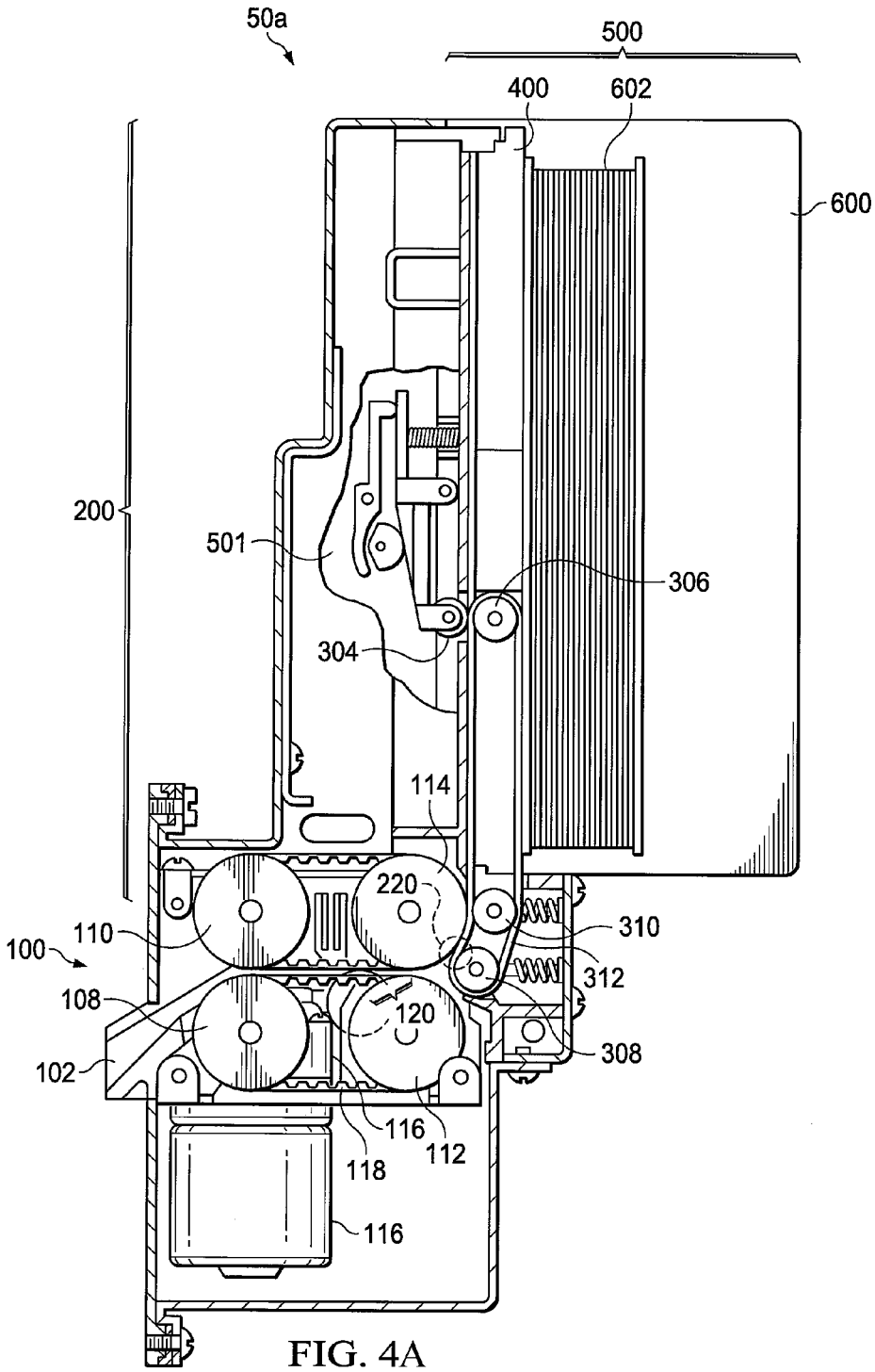
FIG. 4A (PRIOR ART)
FIGS. 4A-4B illustrate prior art implementation of a currency acceptor assembly which may include an example embodiment of an actuated castellation plate.
Figure 4B:
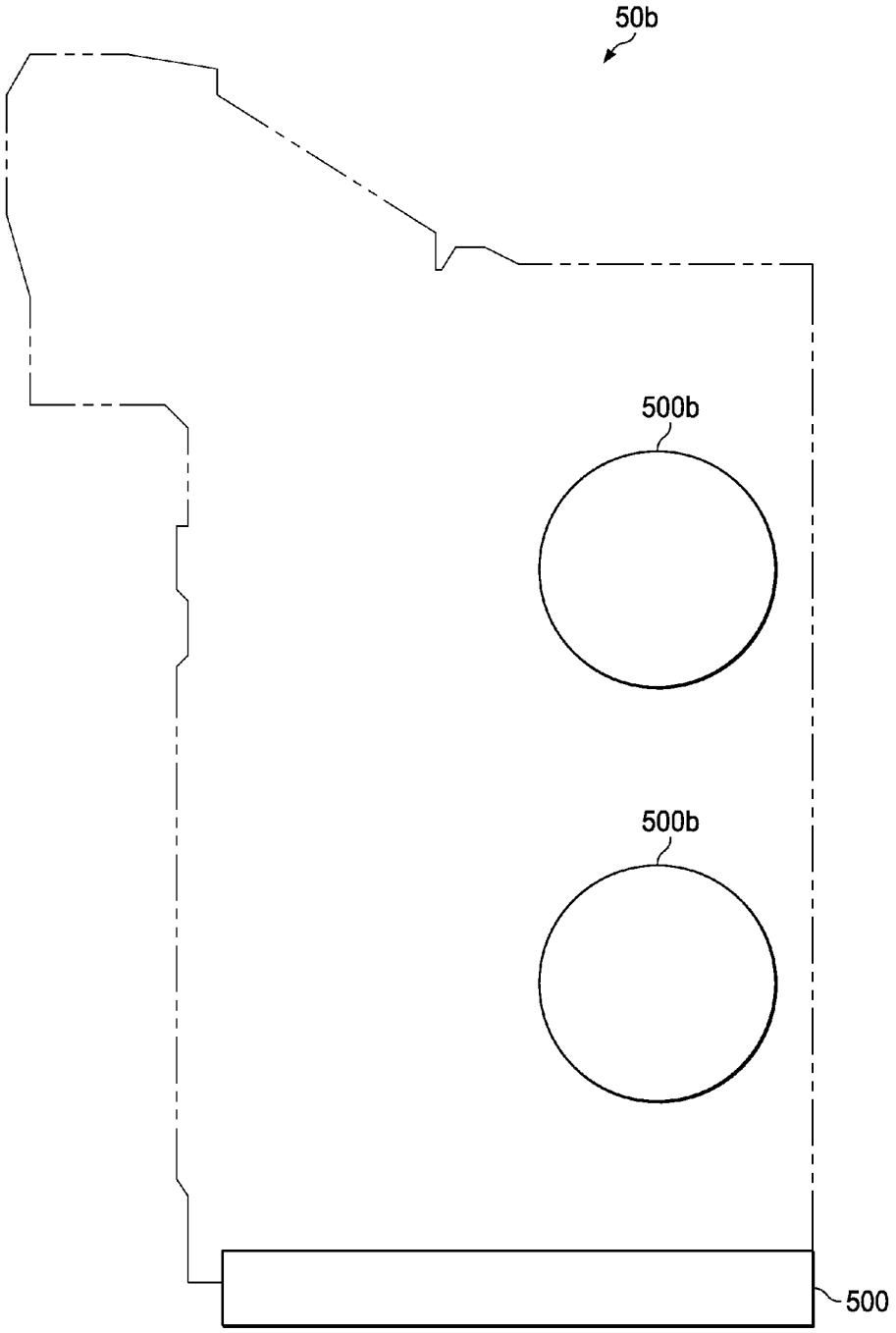

FIG. 1 is a plan view of an example embodiment of an improved castellation plate 10 (also referred to herein as a hook array) for use with a currency acceptor (e.g., as shown in FIGS. 4A and 4B). The castellation plate includes a baseplate 12 and a plurality of tree-shaped teeth 14*a* to 14*i* connected to the baseplate. The baseplate 12 includes opposing end members 24 and 26, one of which or both of which may include a flange. In some example embodiments the end members are a flat-end 26 and a T-end 24. The base plate 12 can further include receptacles 20 and 22. As will be described in more detail below, the receptacles 20 and 22 can be used for mounting a spring or other translational force providing mechanism between the baseplate 12 and a cashbox assembly (not shown).

With respect to the hook array of FIG. 1, each of the teeth 14*a*-14*i* includes branches 16*a* and 16*b* that overlap with, but do not contact, the branches of neighboring teeth to form restricted openings 18 between them. The branches 16*a* and 16*b* of each of the teeth are angled downward to encourage any string-like member or other foreign matter to fall into the restricted openings the purposes of which will be explained in detail below.

Referring again to FIG. 1, the teeth 14*b*-14*d* and 14*f*-14*h* have branches that are also offset from a plane that is parallel to the baseplate 12. The geometry of the teeth is optimized in this manner to minimize the amount of travel that a string attached to a bill must move to become caught in one of the restricted openings between adjacent teeth. The number of teeth fabricated along the length "L" is chosen such that they extend for a length approximately equal to the width of a currency passageway, as will be explained in more detail below. In addition, the hook array 10 may be of a one-piece construction.

Figure 2:
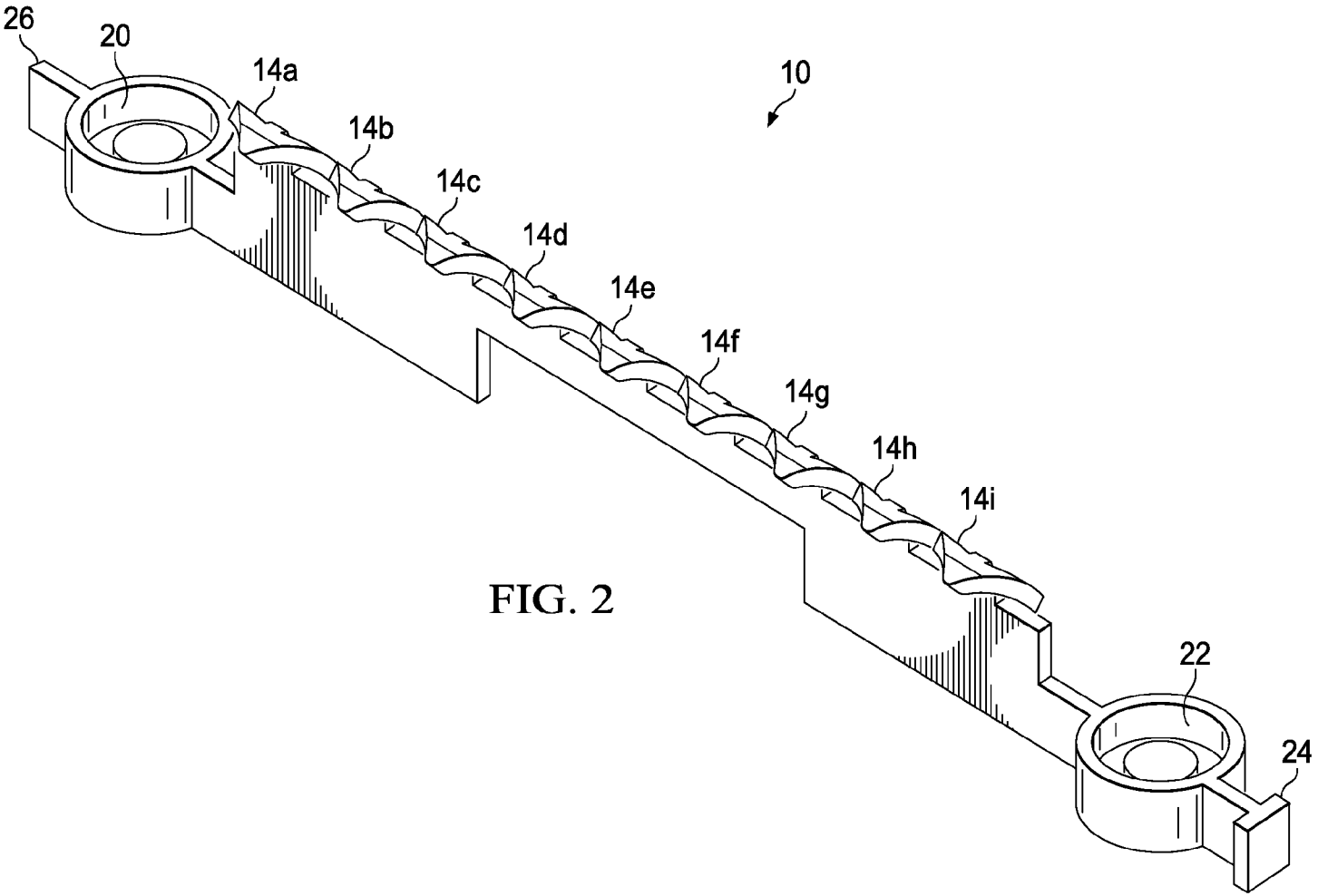
FIG. 2 is a perspective view of the actuated castellation plate of FIG. 1.

FIG. 2 is a perspective view of the example embodiment of the castellation plate 10 of FIG. 1. The perspective view of FIG. 2 more clearly shows the curvature of the hook array teeth 14*a*-14*i*. Other features of the baseplate 12 are more clearly shown, such as the receptacles 20 and 22 and the flat-end 26 and T-end 24.

Figure 3A:
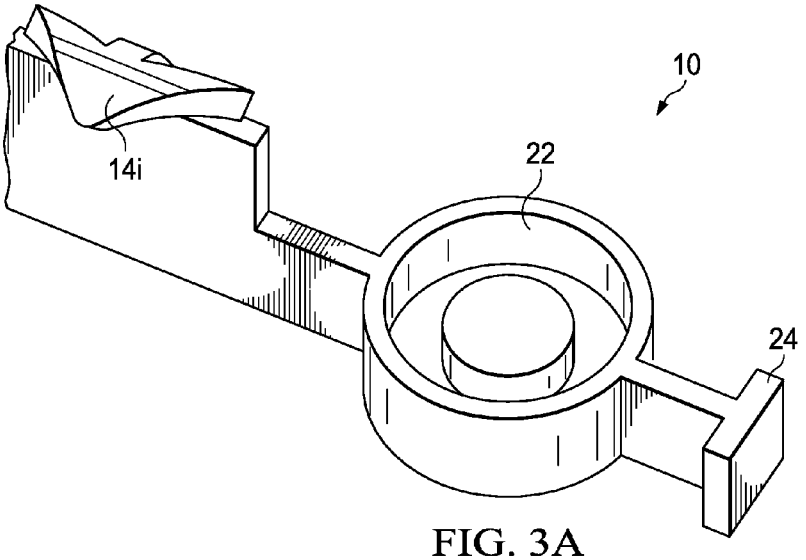
FIGS. 3A-3B are detailed perspective views the actuated castellation plate of FIG. 1.
Figure 3B:
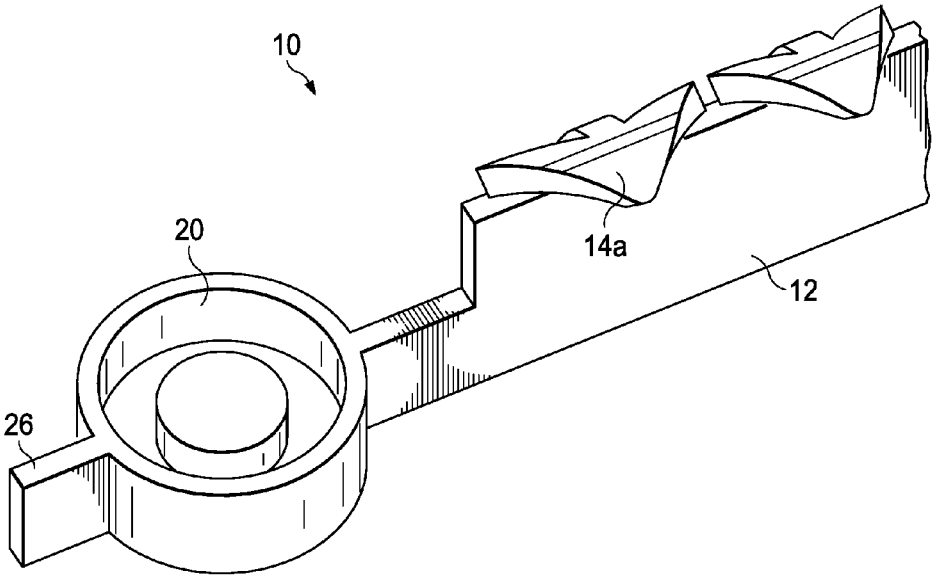

FIGS. 3A-3B show the T-end 24 and flat-end 26, respectively, in further detail. The receptacles 20 and 22 can be generally cylindrical in shape and further include an interior cylindrically shaped portion that matches the outer diameter, to more easily receive and mate with, a helical spring mechanism (54 and 56, as shown in FIGS. 6C-6E) or other translational force mechanism. The ends 24 and 26 generally can be extensions of baseplate 12. The T-end 24 is generally a "T" shape in that a cap or flange portion is coupled to a flat-end in a perpendicular arrangement.

FIG. 4A illustrates a prior art implementation of a currency acceptor assembly 50*a* that includes a bill validator 100 connected to a currency stacker 200. The details of the validator 100 pertaining to banknote validation are not part of this invention, and thus those aspects of the validator are not discussed further. Likewise, various aspects of the electrical and mechanical connection of the validator 100 and the stacker 200 do not form a part of this invention and are not discussed further. It should be understood that the currency acceptor assembly 50*a* illustrated in FIG. 4A is just one example of a currency acceptor configuration which may be retrofitted with the castellation plate 10.

Briefly, bill validator 100 determines whether inserted banknotes are acceptable. Banknotes are inserted one at a time into validator 100 at an entrance of the currency passageway 102. From the entrance of the currency passageway 102, a banknote is transported through the validator 100 to the validator banknote output by a series of pairs of pulleys or rollers 108, 110, 112 and 114 and a pair of belts 118, which grip the side edges of the banknote and which are driven by a drive means 116 including a motor and drive train.

While the banknote is transported through the validator 100, it is tested by a group of sensors to ascertain its validity and denomination. Output signals from the sensors are processed by logic circuits in validator 100 to determine whether the banknote is acceptable. A banknote which is unacceptable is ejected back out through entrance 102 by reversing the drive means 116.

An acceptable banknote is driven by the pairs of belts 118 and the pairs of rollers 112 and 114 into an interconnection region 120 of the currency passageway 102 in which the validator 100 and the stacker 200 are connected together. In this example, the stacker 200 and cashbox 600, each of which are parts of the cashbox assembly 500 (a type of currency storage assembly), are connected to the validator 100 in what is commonly known as an "up-stacker" configuration because accepted bills are transported from a horizontal orientation upwards to a vertical orientation. It should be understood, however, that an example embodiment of the actuated castellation plate according to the invention may be used in currency acceptors configured in other ways, such as in a "down-stacker" configuration. Referring again to FIG. 4A, the interconnection means in the interconnection region 120 establishes a smooth uninterrupted path for a banknote to follow in leaving validator 100 and entering stacker 200. The interconnection means establishes the initial portion of the currency passageway 102 in the stacker 200 and serves to direct the leading edge of the banknote to the region 220 where the two side edges of the banknote are gripped between rollers 308, belts 312 and stacker drive rollers 114.

The stacker 200 includes transport means having a series of pairs of pulleys 306, 308 and 310, a pair of belts 312, and a pair of retractable pinch rollers 304. It should be recognized that one of each of the above components 306, 308, 310 and 312 is located on each side of the banknote path, and the validator roller 114 drives the transport means.

The accepted banknote is transported from the entrance of the cashbox assembly 500 into a pre-storage compartment 400. In a fashion somewhat analogous to the way that a picture frame holds a picture, compartment 400 "frames" the banknote and holds it stiff prior to stacking. A central region is open, and a pusher plate 502 (shown in FIG. 5) which is part of the cashbox assembly 500 passes through this opening as it strips a banknote from compartment 400, and pushes it into the cashbox 600.

After a predetermined distance of travel sufficient to allow the accepted banknote to be fully driven into a compartment 400 by the transport means, the retractable pinch rollers 304 are retracted, and the pusher means 501 is operated. (It should be understood that other types of bill acceptors might use alternate methods to transport a bill into a prestorage compartment and to monitor its progress before storing the bill.) A mechanical portion of the pusher means 501 is shown, but the details of its operation are not part of the present invention and thus will not be discussed in detail herein. Pusher means 501 forces the accepted banknote from prestorage compartment 400 into a stack 602 in the cashbox 600 where it is stored until removed by service personnel. The cashbox 600 is designed to be readily removed, or opened so that stacked banknotes can be collected.

FIG. 4B is a further example embodiment of a currency acceptor assembly 50*b*, which can be used with the actuated castellation plate 10 described herein. The currency acceptor assembly 50*b* operates in a similar manner to the currency acceptor assembly 50*a* of FIG. 4A described above, and, as such, will not be discussed in further detail. The currency acceptor assembly 50*b* can include one or more recycler assemblies 500*b*, a type of currency storage assembly which is used to recycle denominations of currency previously accepted by the ATM to provide change due to a customer as part of a transaction. As shown in the example currency acceptor assembly of FIG. 4B, the recycler assemblies 500*b* can be in a vertical configuration, each having an entrance and exit coupled to the currency passageway (not shone in detail) so that the recycler assemblies 500*b* can accept particular currency denominations. For example, the recycler assemblies 500*b* can store and return $1 and $5 denominations for use in providing change to a customer to complete a transaction. The currency acceptor assembly 50*b* can further include a cashbox assembly 500. The cashbox assembly 500 and recycler assemblies 500*b* are referred to herein generally as currency storage assemblies, as the function of each is to store currency.

Now that example embodiments of currency acceptors and the overall operation from banknote insertion to stacking and removal have been briefly discussed, the details of the apparatus according to the present subject matter will be described in greater depth.

Figure 5:
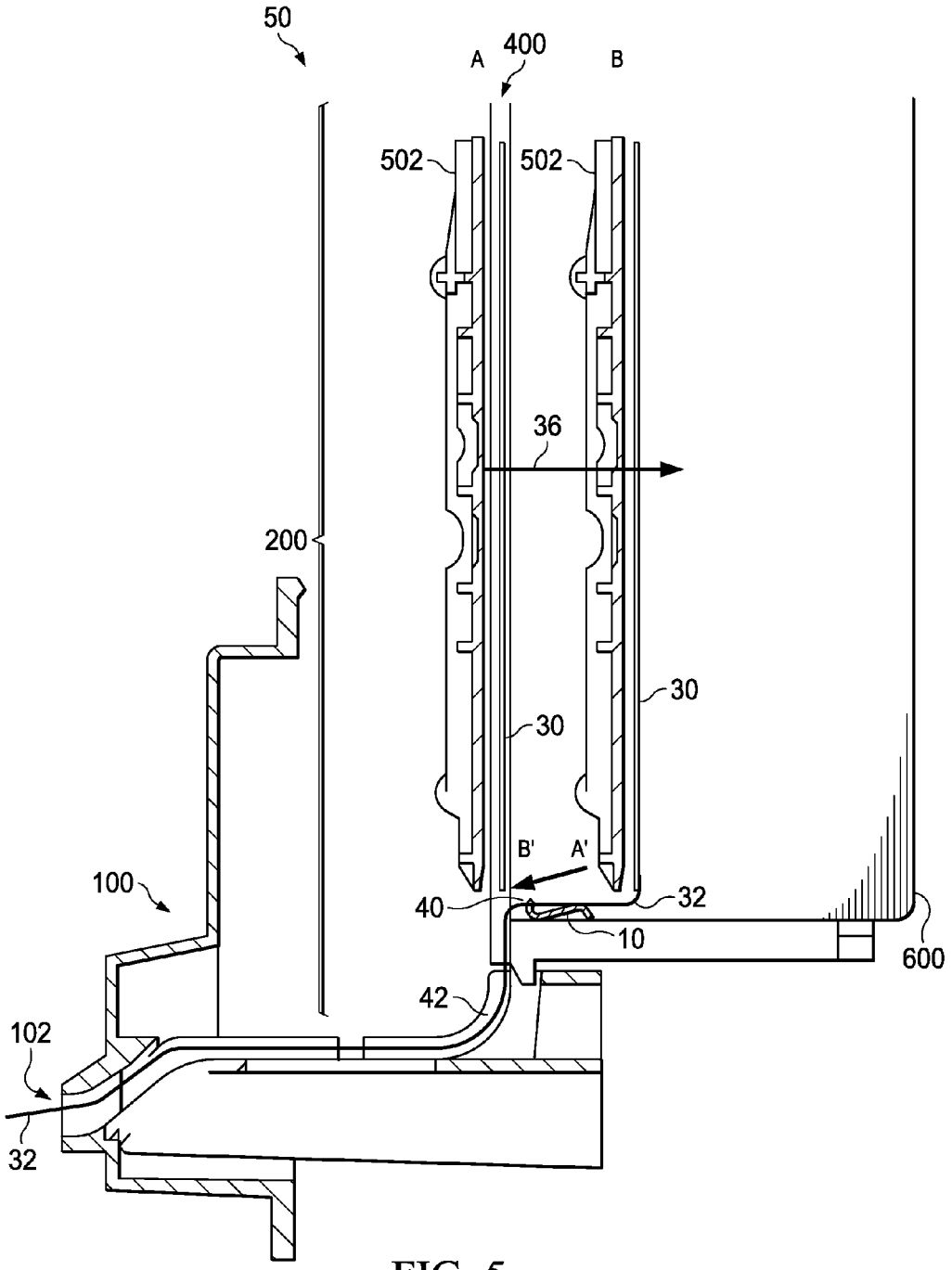
FIG. 5 is a schematic diagram of a bill acceptor assembly including an example embodiment of an actuated castellation plate.

FIG. 5 is a cross-sectional schematic diagram of a currency acceptor assembly 50 incorporating an example embodiment of a castellation plate 10. FIG. 5 illustrates two positions "A" and "B" of the pusher plate 502 for the case wherein a thief has inserted a genuine bill 30 with attached tail 32 (also referred to herein as a bait bill 30), into the currency validator 50. This is done by a thief to defraud the currency acceptor by first allowing the bill to be authenticated and then stored in the cashbox 600, receiving the product or service, and then pulling on the tail 32 to retrieve the bait bill 30 from the cashbox 600 back out of the entryway.

In the above example the thief inserts the bait bill 30 connected to the tail 32 into the entryway of currency passageway 102, wherein after being accepted by the bill validator 100, the bill 30 is then transported to the bill stacker 200 for storage in the cashbox 600. The bill 30 is first transported to the pre-storage compartment 400 wherein the pusher plate 502 begins in position A. The pusher plate 502 then operates to move in the direction of arrow 36 to position B to push the bill 30 into cashbox 600. As the bill 30 is moved in this manner to position B, the motion of the pusher plate 502 and movement of the bill 30 drags the tail 32 against the castellation plate 10. When the thief attempts to retrieve the bill 30 by pulling on the tail 32, the pressure and/or friction caused by the tail 32 and the bill 30 will actuate the castellation plate 10 from an open state "A'" to a closed state "B'" at area 40. The open state A' enables the bill 30 to travel unimpeded into the cashbox 600 as described above. The closed state B' prevents the bill 30 from moving backwards toward the bill entryway by obstructing the currency passageway 102.

As shown in FIG. 5, the castellation plate 10 is mounted using mounting assembly 501 (shown in FIG. 6A) between the cashbox 600 and a first portion of the currency passageway 102 at the cashbox assembly 500 entrance 42 to inhibit such retrieval of paper currency. If the tail 32 is relatively weak, it may snap when the thief pulls. Since the bill has already been safely stored, this is an acceptable result. Alternately, the thief may abandon the tail 32 when he realizes that the bait bill 30 cannot be retrieved which may cause the currency validator to go out of service. Although the next customer who tries to use the automatic transaction machine will be disappointed, such an event is somewhat beneficial because then a service call is required. When service personnel arrive and verify that a fraud has been attempted, a surveillance tape can be checked to identify the thief for possible arrest or banishment from the establishment. Further, after a thief repeatedly fails to succeed in his attempt to defraud the machine, the incidence of string-fraud attempts will drop. Although the castellation plate 10 is mounted along the currency passageway 102 at the cashbox assembly entrance 42 in the example embodiment illustrated in FIG. 5, the castellation plate 10 can be mounted along any length of the currency passageway 102 between the currency validator assembly and the currency storage assembly. For example, the castellation plate 10 can be mounted immediately following the currency validator (i.e., at the exit of the currency validator), such that the currency can travel along the currency passageway through the validator, through the castellation plate, and then to a currency storage assembly (e.g., cashbox, recycler assembly, etc.).

Figure 6A:
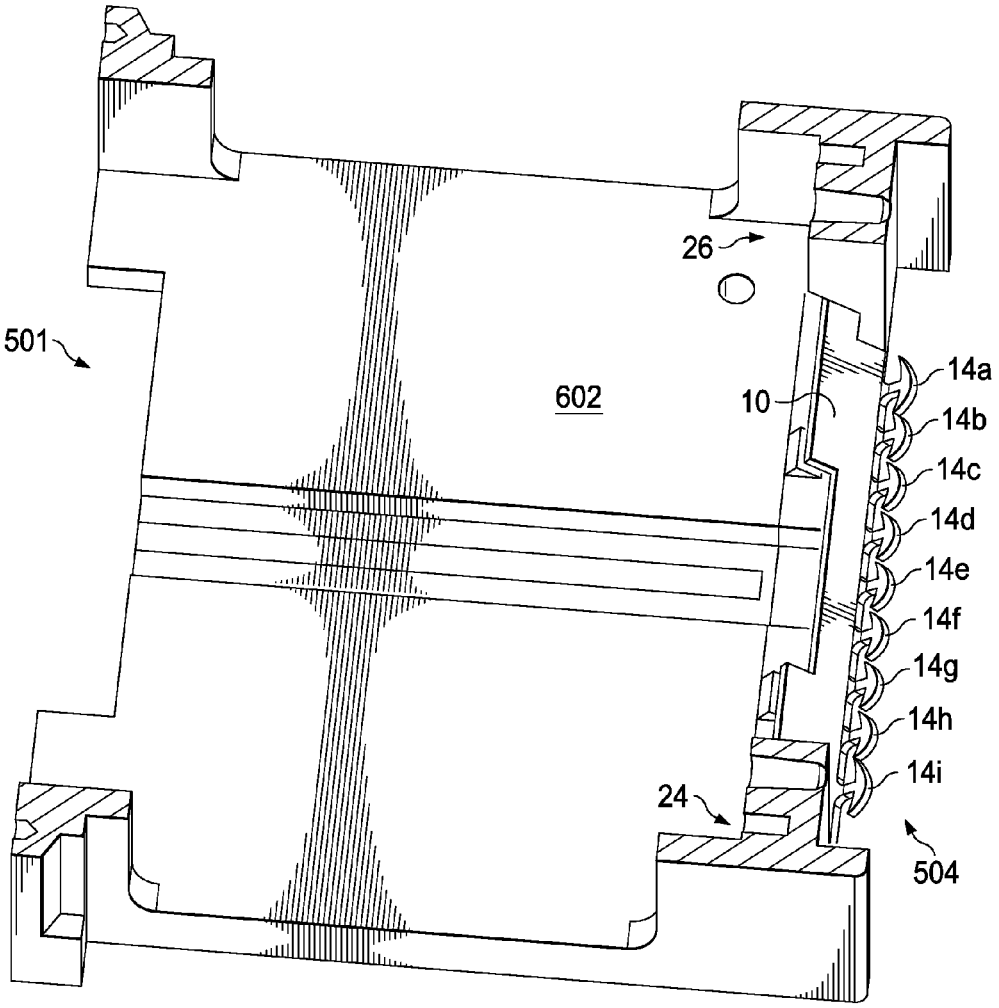
FIG. 6A-6E are partial cutaway perspective views of an example embodiment of a cashbox assembly for implementation with the actuated castellation plate of FIG. 1.

FIG. 6A is a perspective cutaway view of an example implementation of a mounting assembly 501 (which can be integral to cashbox assembly 500 as presented) to illustrate arrangement of a castellation plate 10. As shown, the castellation plate 10 may be configured in an off-horizontal arrangement with a side wall 602 using receptacles 20 and 22 (not shown in FIG. 6A) and mounting ends 24 and 26. For example, the off-horizontal arrangement of the castellation plate 10 from the side wall 602 of mounting assembly 501 can be at an angle ranging from 0 degrees (horizontal) through 45 degrees or more, with 22 degrees being a preferred arrangement. As illustrated in FIG. 6A, the castellation plate 10 is fully translated and in a closed state B' (as shown in FIG. 5). A spring mechanism (50 and 52 shown in FIG. 6C) or other translational force providing mechanism can be couple to and arranged between the mounting assembly receptacles (620 and 622 in FIG. 6B) and the receptacles 20 and 22 of the castellation plate 10 to provide force to translate the castellation plate 10 into an open state A' (as shown in FIG. 5). The castellation plate 10 can be arranged such that the teeth 14*a*-14*i* are oriented in a slightly inward facing direction in relation to the bill opening 504. The teeth 14*a*-14*i* can be angled or curved towards the stacked notes so that they do not obstruct any part of an accepted bill as it is pushed into the cashbox 600 (shown in FIG. 5), while at the same time catch any bill being pulled out and thus actuate the castellation plate to closed position B'. It should be understood that the baseplate 12 of the hook array can be formed to include alternate receptacles, connection points, and cut-out portions to enable the easy retrofit to existing cashbox assemblies for various currency acceptor assemblies, as well as to fit new currency acceptor designs.

Figure 6B:
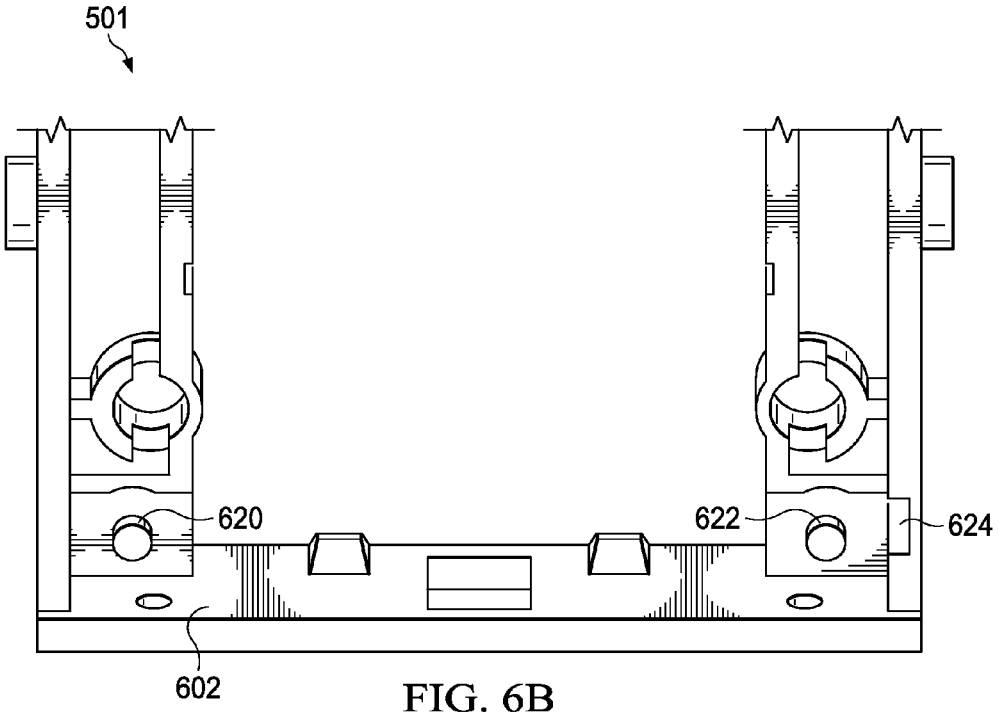
Figure 6C:
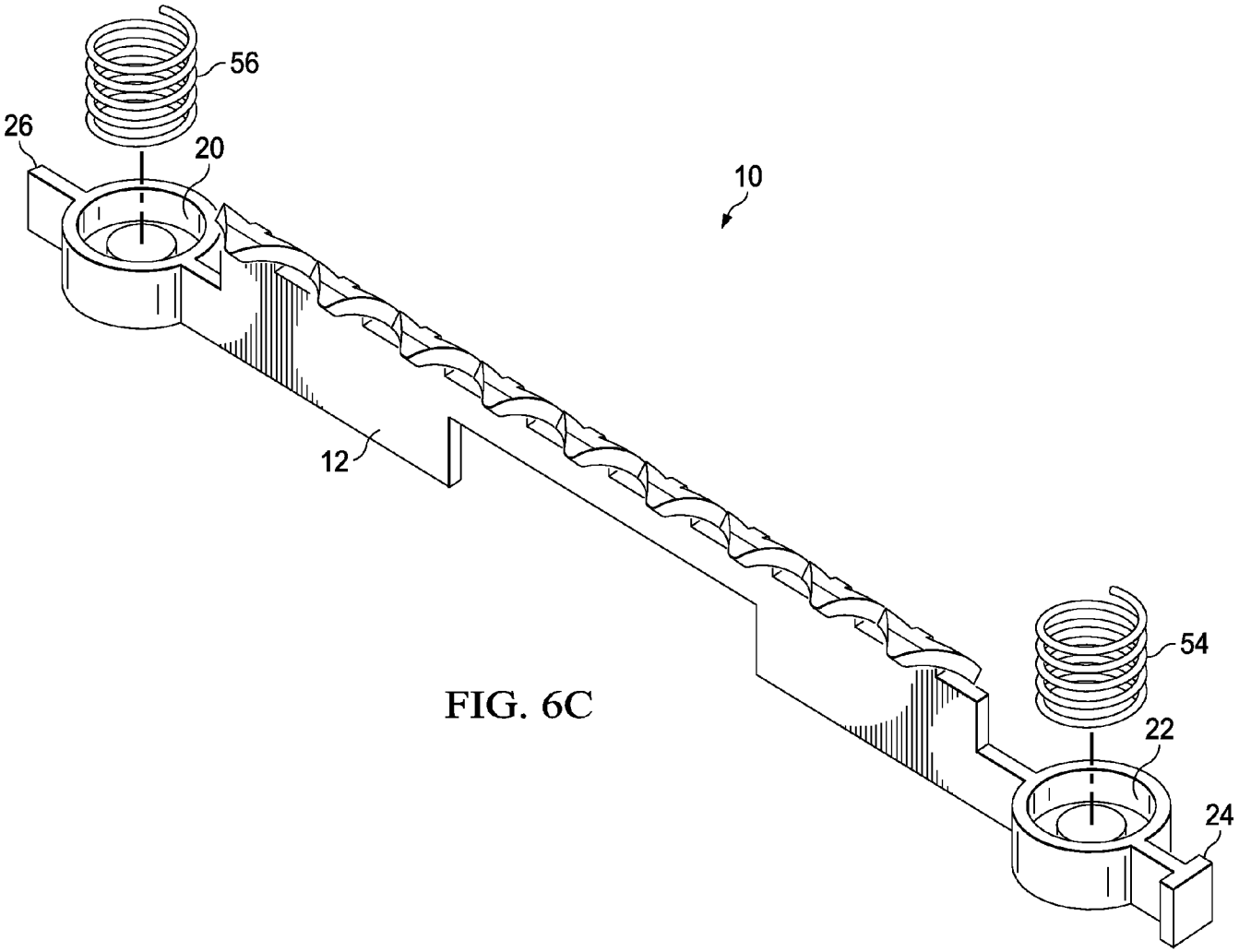
Figure 6D:
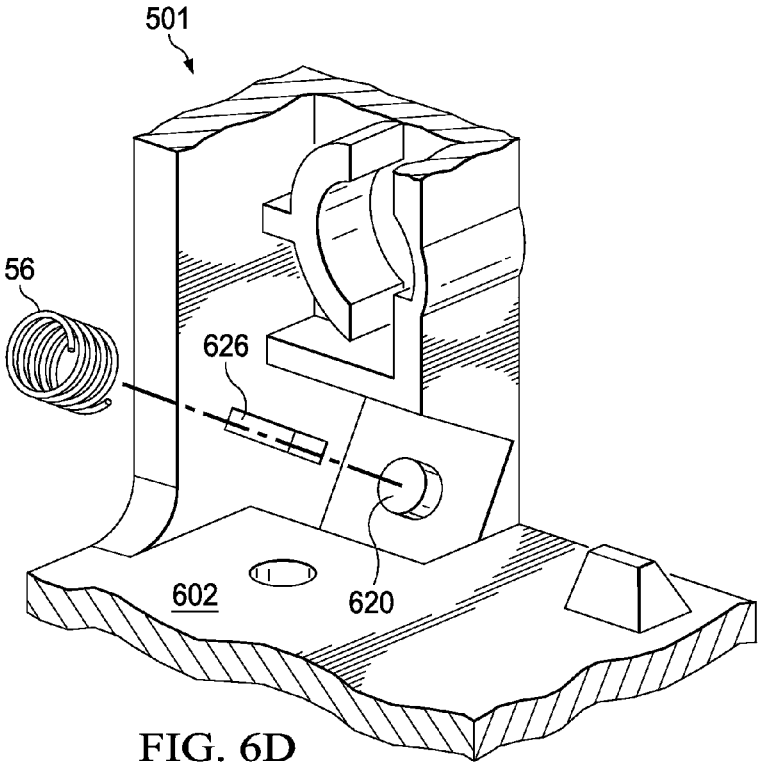
Figure 6E:
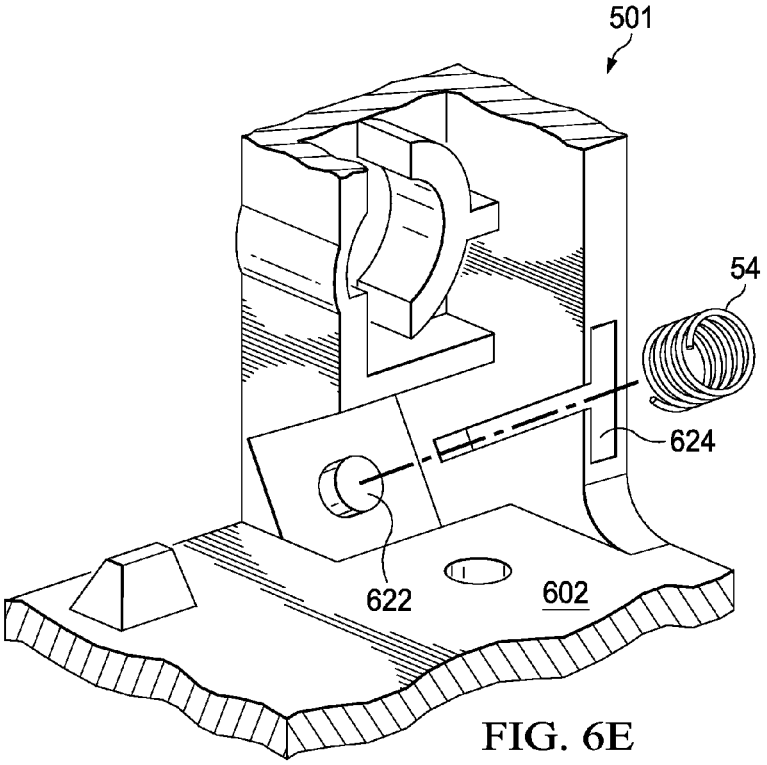

FIG. 6B is a partial perspective end view of an example embodiment of the mounting assembly 501. FIG. 6C illustrates an example assembly of the castellation plate 10 with spring mechanisms 56 and 54, which can couple to receptacles 20 and 22, respectively. FIGS. 6D and 6E are alternative partial perspective end views of the example embodiment of the mounting assembly 501 illustrating different features for coupling the castellation plate 10 to the currency passageway (102 in FIG. 4A) at the entrance of the cashbox assembly 500. Mounting assembly receptacles 620 and 622 can be coupled to a first end of spring mechanisms 56 and 54 or other translational force mechanisms, and the second end can be coupled to the castellation plate receptacles 20 and 22, respectively (shown in FIG. 6C). T-groove 624 is a "T" shaped groove that matches and corresponds to the T-end 24 of the castellation plate 10. Slot 626 is a closed groove that matches and corresponds to the flat-end 26 of the castellation plate 10. The T-groove 624 and slot 626, or other types of ridges or grooves, can be parallel to each one another and angled off horizon, preferably at 22 degrees off horizon. The T-groove 624 and slot 626 enable the castellation plate 10 to slide forward into the currency passageway 102 when pressure is applied by a tail or string-like member, thus allowing the castellation plate 10 to completely block the currency passageway 102 and preventing the fraud. Pressure from the spring mechanisms 56 and 54 or other translational force mechanism can cause the castellation plate 10 to bounce back into the open state A' from the closed state B', thus allowing bills to be transported into the cashbox assembly 500. In a preferred embodiment, the castellation plate 10 can slide a maximum of 3.25 mm into the currency passageway 102 before it is stopped by either the collision of the teeth 14*a*-14*i* with opposite side of the currency passageway 102 or by the spring mechanisms 56 and 54 which will be at their fully condensed position. The T-groove 624 and slot 626 provide mechanical support for mounting of the castellation plate 10 using mounting assembly 501, preferably at the entrance of the cashbox assembly 500. Additionally, by using the T-groove 624 and slot 626 the castellation plate 10 is keyed so as to allow only proper installation and prevent incorrect assembly. It should be understood that the flat-end, T-end and corresponding slot and T-groove are provided as illustrative examples and should not be construed as limiting the scope of the present invention.

The tree-shaped teeth 14*a*-14*i* can be angled, and when connected to a bill acceptor assembly the teeth face towards the cashbox 600 in the direction of arrow 36 (as shown in FIG. 5) so as not to impede the progress of an accepted bill. Further, the top portions of the teeth 14*a*-14*i* may be made smooth to further allow for unimpeded entry of a bill into the cashbox 600, and to encourage a string to enter and be trapped within a restricted opening 18. In contrast, the lower, inner surface of the teeth 14*a*-14*i* that forms the restricted opening may be rough or abrasive to promote the actuation of the castellation plate 10 to the closed state B' and the further obstruction of a bill in the reverse direction.

Alternate implementations of a hook array structure may include a base plate 12, a plurality of tree-shaped teeth 14*a*-14*i*, a cut-out portion 25 and an aperture or connection point. An alternate hook array may include a base plate 12, teeth 14*a*-14*i*, central cut-out portion 25 and two connection points located on flanges. Another alternate hook array may include a base plate 12, teeth 14*a*-14*i*, central cut-out portion 25, flanges and connection points. It should be understood that the connection points or end mounts could be circular, oval or other shape. Further, the flanges could be of different dimensions and shapes in order to facilitate connection to a currency acceptor, cashbox assembly or other support structure. As described above, when the castellation plate is connected, the teeth permit a banknote to enter a cashbox and prevent a thief from pulling the banknote back out of the currency acceptor by using a tail or string to retrieve the banknote.

A number of embodiments of the invention have been described. Nevertheless, it will be understood that various modifications may be made without departing from the spirit and scope of the invention. For example, the hook array 10 may include areas within the restricted openings 18 that have sharp edges or blade structures that may operate to engage, cut, rip or tear the string when a thief attempts to pull a bill out of the cashbox. Such sharp edges may be fabricated to only engage and cut objects that move in a direction that is opposite to the direction of an accepted bill that has been stacked in the cashbox. If the restricted openings include such sharp edges, then the largest diameter of the restricted openings should be made sufficiently small to prevent insertion of a finger in order to protect personnel entrusted with removing and emptying full cashboxes.

Further exemplifying the scope of the present subject matter, currency acceptors may include coin validators, operative to validate coinage, and an embodiment of a castellation plate may be tailored to the typically narrower currency passageway used for coinage. Such currency acceptors equipped with coin validators may be further equipped with currency storage assemblies, such as coin tubes or coin hoppers, coupled to the currency passageway. Accordingly, other embodiments are within the scope of the following claims.

What is claimed is:

1. A currency acceptor assembly comprising:

a currency storage assembly configured to receive a banknote from a currency passageway; and a castellation mounted on the currency storage assembly and configured to:

bias to an open state, transition from the open state to a closed state in response to a first movement of the banknote from the currency storage assembly towards the currency passageway, and prevent a second movement of the banknote from the currency storage assembly into the currency passageway by transitioning from the open state to the closed state.

2. The currency acceptor assembly of claim 1, further comprising a currency validator including an exit coupled to the currency passageway and configured to guide the banknote in a forward direction from the exit of the currency validator toward the entrance of the currency storage assembly, wherein a pusher plate positioned between the currency validator and the currency storage assembly.

3. The currency acceptor assembly of claim 1, further comprising a recycler assembly coupled to the currency passageway and configured to recycle one or more previously received banknotes.

4. The currency acceptor assembly of claim 1, further comprising a pusher plate configured to guide the banknote from the currency passageway into the currency storage assembly.

5. The currency acceptor assembly of claim 1, wherein the castellation mounted is configured to transition from the open state to the closed state by an external pressure.

6. The currency acceptor assembly of claim 1, further including a spring mechanism coupled to the currency storage assembly and configured to bias the castellation to the open state.

7. The currency acceptor assembly of claim 6, wherein a receptacle of a baseplate is a first receptacle and the spring mechanism is a first spring mechanism, wherein the baseplate further includes a second receptacle, wherein the first receptacle and second receptacle are positioned on opposing sides of the baseplate, and wherein the currency acceptor assembly further includes a second spring mechanism coupled to the currency storage assembly and the second receptacle of the baseplate, and wherein the second spring mechanism is configured to bias the castellation to the open state.

8. The currency acceptor assembly of claim 1, wherein the castellation further includes an array of teeth coupled to a baseplate, wherein the baseplate includes a receptacle and two opposing mounting ends that are mounted to the currency storage assembly.

9. The currency acceptor assembly of claim 8, wherein the array of teeth are tree-shaped teeth forming restricted openings therebetween, and wherein at least some of the teeth are adjacent to one another in a direction across the currency passageway, partially overlap one another without contacting one another, and are angled such that any string-like member attached to the banknote will be trapped within a restricted opening to further prevent extraction of the banknote.

10. The currency acceptor assembly of claim 8, wherein the two opposing mounting ends of the baseplate include a flat-end and a T-end, and wherein the currency storage assembly further includes a flat-groove and a T-groove matching the corresponding flat-end and the T-end, respectively, and is positioned at the entrance of the currency storage assembly.

11. The currency acceptor assembly of claim 10, wherein the flat-groove is a slot and the T-groove has a closed-end and an open-end.

12. The currency acceptor assembly of claim 10, wherein the flat-groove and the T-groove are further arranged off-horizontal.

13. A currency acceptor assembly comprising:

a currency storage assembly configured to receive a banknote from a currency passageway; and a castellation mounted on the currency storage assembly and configured to:

bias to an open state, transition from the open state to a closed state when a string-like member coupled to the banknote is pulled from the currency storage assembly towards the currency passageway, and prevent a movement of the banknote from the currency storage assembly into the currency passageway by transitioning from the open state to the closed state.

14. A hook array for use with a bill acceptor comprising:

a plurality of tree-shaped teeth forming restricted openings therebetween and positioned in a currency passageway of the bill acceptor, wherein at least some of the teeth are adjacent one another in a direction across a width of the currency passageway, partially overlap one another without contacting one another, and wherein the teeth are angled to trap a string-like member attached to a banknote within a restricted opening to prevent an extraction of the banknote from a currency storage assembly when the string-like member is pulled away from the currency storage assembly; and wherein the plurality of tree-shaped teeth are biased towards an open position and are configured to transition from the open position to a closed position to at least partially obstruct an opening from the currency passageway to the currency storage assembly and to prevent the extraction of the banknote from the currency storage assembly.

15. The hook array of claim 14, wherein a top portion of at least one of the teeth is curved to promote unimpeded travel of a bill in a first direction towards the currency storage assembly.

16. The hook array of claim 14, wherein an inner surface of at least one of the teeth is abrasive to promote movement of the teeth to the closed position thereby obstructing the currency passageway to prevent the banknote bill from moving in a second direction from the currency storage assembly towards the currency passageway.

17. The hook array of claim 14, further includes a baseplate connected to the plurality of tree-shaped teeth.

18. The hook array of claim 17, wherein the baseplate further includes at least one receptacle to receive a spring mechanism.

19. The hook array of claim 17, wherein the baseplate and the teeth are of a unitary construction.

20. The hook array of claim 17, wherein the baseplate further includes a flat end.

21. The hook array of claim 17, wherein the baseplate further includes at least one flange positioned at a flange end.

22. The hook array of claim 21, wherein the at least one flange is a T-shaped end.

23. A currency acceptor comprising:

a currency passageway configured to transport a banknote in a direction towards an entrance of a currency storage assembly; and a castellation configured to bias to an open state and transition between the open state that enables a transport of the banknote from the currency passageway to the currency storage assembly and a closed state preventing a first movement of the banknote from the currency storage assembly into the currency passageway, wherein the castellation is configured to transition from the open state to the closed state in response to a second movement of the banknote from the currency storage assembly towards the currency passageway.

* * * * *